US006543494B2

(12) United States Patent
Bellin et al.

(10) Patent No.: US 6,543,494 B2
(45) Date of Patent: Apr. 8, 2003

(54) APPARATUS AND METHOD FOR FILLING LIQUID CONTAINERS

(76) Inventors: Dale W. Bellin, 28385 FR 525, Coupeville, WA (US) 98239; Donald H. Green, 3244 C.R. 400, Freeport, TX (US) 77541

( * ) Notice: Subject to any disclaimer, the term of this patent is extended or adjusted under 35 U.S.C. 154(b) by 0 days.

(21) Appl. No.: 09/864,352

(22) Filed: May 25, 2001

(65) Prior Publication Data

US 2002/0174911 A1 Nov. 28, 2002

(51) Int. Cl.[7] ..... B65B 1/04
(52) U.S. Cl. ..... 141/192; 141/301; 141/95
(58) Field of Search ..... 141/192, 198, 141/301, 302, 94, 95, 83, 374, 369

(56) References Cited

U.S. PATENT DOCUMENTS 3,830,265 A * 8/1974 Matejek ..... 137/170.1
4,749,010 A * 6/1988 Petell ..... 141/115
5,588,471 A * 12/1996 Lowe ..... 137/393
6,053,219 A * 4/2000 Seiver ..... 141/374

* cited by examiner

*Primary Examiner*—Steven O. Douglas
(74) *Attorney, Agent, or Firm*—Bill B. Berryhill

(57) ABSTRACT

Apparatus and method for filling containers with liquid including a vertically disposed filling lance operatively connected to a source of liquid and to a power device by which the lance may be vertically moved between raised and lowered positions. A tubular rod extends upwardly through the lance for operative connection to an actuator by which the tubular rod and a foot valve of the lower end of the lance may be vertically moved between closed and open positions. A pressure transducer detects fluid pressure in the tubular rod and converts the pressure to a proportional signal which is transmitted to the power device for raising the lance a predetermined amount while keeping the foot valve and lower end of the lance submerged beneath the surface of container liquids.

16 Claims, 3 Drawing Sheets

APPARATUS AND METHOD FOR FILLING LIQUID CONTAINERS

BACKGROUND OF THE INVENTION

1. Field of the Invention

The present invention pertains to apparatus and methods for filling containers with liquid. More specifically, the present invention pertains to drum filling apparatus, and methods of the use thereof, which are provided with a tubular filling lance through which liquid is transferred to a drum and which is vertically moveable by a power device between raised and lowered positions in response to various control signals.

2. Description of the Prior Art

There are many apparatus designs for filling drums with liquid. Some of the most successful and efficient filling apparatuses are those of the type having a tubular filling lance which is operatively connected to a source of liquid and which is vertically moveable by a power device between raised and lowered positions. The lance is positioned above an opening in the drum and lowered into the drum for filling thereof. After the container is filled, the lance is returned to a fully raised and/or withdrawn position.

In many situations, particularly in filling drums with liquids susceptible to foaming, the lance is lowered into the drum to a position just above the bottom of the drum before fluid is introduced through the lance. In early versions of drum fillers, the lance remained totally submerged as the drum was filled to its final capacity. Then the lance was withdrawn from the drum. A number of later drum fillers have been provided with features in which the lower end of the lance would be submerged in the liquid but the lance would be moved upwardly as the drum is filled so that just the lower end of the lance is submerged in liquid until the drum is filled. When the drum is filled to a predetermined amount or weight, then the lance is raised to an uppermost raised position, out of the drum, allowing the filling opening to be plugged and the filled drum to be further handled for shipping and/or storage.

There are several reasons for keeping the lower end of the lance slightly submerged below the surface of the liquid, as it is being introduced into a drum, such as minimizing product contact with air, reducing static electric charges and preventing foaming and splashing. Foaming and splashing may result in less accurate and efficient measuring of liquids and may create additional fumes or vapors which might be more difficult to dispose of. Another reason for keeping only a small portion of the lance submerged in the liquid during filling is to prevent wetting of the rest of the lance with quick setting liquids, making it difficult to remove excess material therefrom and difficult to determine the final weight of the container since a substantial amount might drip from the lance after it is removed from the drum. Even in apparatus and methods in which only the lower end of the lance is submerged in the liquid, wiper rings and drip collectors are frequently provided to minimize this problem.

In most recently designed drum fillers, raising of the lance is in response to weight of fluid in the drum as indicated by a signal transmitted from a scale to a controller. With such apparatus and methods the lance is lowered into the drum to a predetermined position just above the bottom of the drum. Control valves are opened to introduce liquid into the drum and the lance is simultaneously raised, so that its lower end is kept submerged just below the surface of the liquid, until a predetermined weight of liquid is in the drum. Then control valves reduce the flow rate to a dribble-fill rate until a predetermined target net weight of liquid within the drum is reached. Then the control valves are completely closed, terminating flow from the source of liquid. Two of the more recent and successful drum fillers of this type, sometimes referred to as "raise by weights" fillers, are disclosed in U.S. Patent Nos. 4,703,780 and 6,053,219.

U.S. Patent No. 4,957,147 discloses a drum filler in which the level of fluid in the drum and ascent of the lance is monitored and controlled by monitoring pressure in a pair of sensor tubes, one to sense when the lance is being withdrawn too quickly and the other to sense when the lance is not withdrawn quickly enough. These tubes pass through the sidewalls of the lance and extend downwardly, one terminating near the bottom of the lance and the other being spaced somewhat above.

Even though these recently designed drum fillers are substantially better than those of the prior art, improvements can be made; particularly in the handling of volatile products and in the tracking or raising of the lance so as to keep only a very small portion of the lance submerged in the liquid. In addition, it is not uncommon for a lance to be lowered into a drum which is already filled, causing a substantial portion of the lance to be coated with the filling material and possibly resulting in spills and overflows. If improvements could be made which would prevent this from happening, it would be well received. Continued improvements are needed.

SUMMARY OF THE PRESENT INVENTION

The present invention provides improved apparatus and methods for filling drums with liquid of a type which has a tubular filling lance operatively connected to a source of liquid and which is vertically moveable between raised and lowered positions. However, the lance in the apparatus and method of the present invention is raised or tracked by a method other than "raise by weight". It is raised in response to pressure.

The lance of the present invention is similar to drum filler lances of the prior art in that it is provided with a foot valve which is connected to a rod extending upwardly from the foot valve through the lance to an actuator which reciprocates the rod to open and close the foot valve. However, unlike operating rods of the prior art, the rod of the present invention is tubular and the foot valve is provided with a central port in communication with the interior of the rod. The interior of the tubular rod is in communication, through a conduit, with a pressure transducer which, with associated circuitry, converts pressure to a proportional electrical signal for transmission to control elements for raising the lance.

In operation, the lance is lowered into a drum and the toot valve is opened, allowing fluids to begin filling the drum. As liquid enters the drum and covers the bottom of the lance it creates a pressure within the rod which is transmitted through the conduit to the transducer. When pressure reaches a first predetermined amount, for example two inches of water, the transducer transmits an electrical signal to a controller which sends a signal to a carriage on which the lance is mounted, raising the lance a specified amount but keeping the lower end of the lance and the foot valve submerged beneath the surface of the liquid. As the lance is raised, pressure in the tubular rod is reduced sending a signal to stop raising the lance until liquid again rises in the tubular rod to create a pressure which through the transducer and the electrical circuitry causes the lance to raise again. This process continues so that the lance is raised incrementally until the drum is completely full. As it is raised, only a small portion of the lower end of the lance is submerged in the liquid. Most of the lance is never submerged in the liquid.

In preferred embodiments of the invention, the tubular rod is also in communication with a source of low pressure gas, such as air or an inert gas. Although this feature is not necessary in all cases, its primary purpose is to clear the tubular rod, particularly in the case of very viscous fluids, so that a true pressure is always transmitted to the pressure transducer. If the drum is being filled with a volatile fluid, the gas provided can be an inert gas so that a blanket of inert gas will cover the liquid.

The pressure sensing in the tubular rod of the present invention is primarily for tracking and raising of the lance. However, it also serves as a warning if the drum is completely or partially filled, such being indicated by pressure in the tubular rod as the lance is lowered into the drum. Thus, accidental mixing of products and unwanted coating of the lance is prevented. Many other objects of the invention will be apparent from reading the description which follows in conjunction with the accompanying drawings.

DESCRIPTION OF PREFERRED EMBODIMENTS

Figure 1:
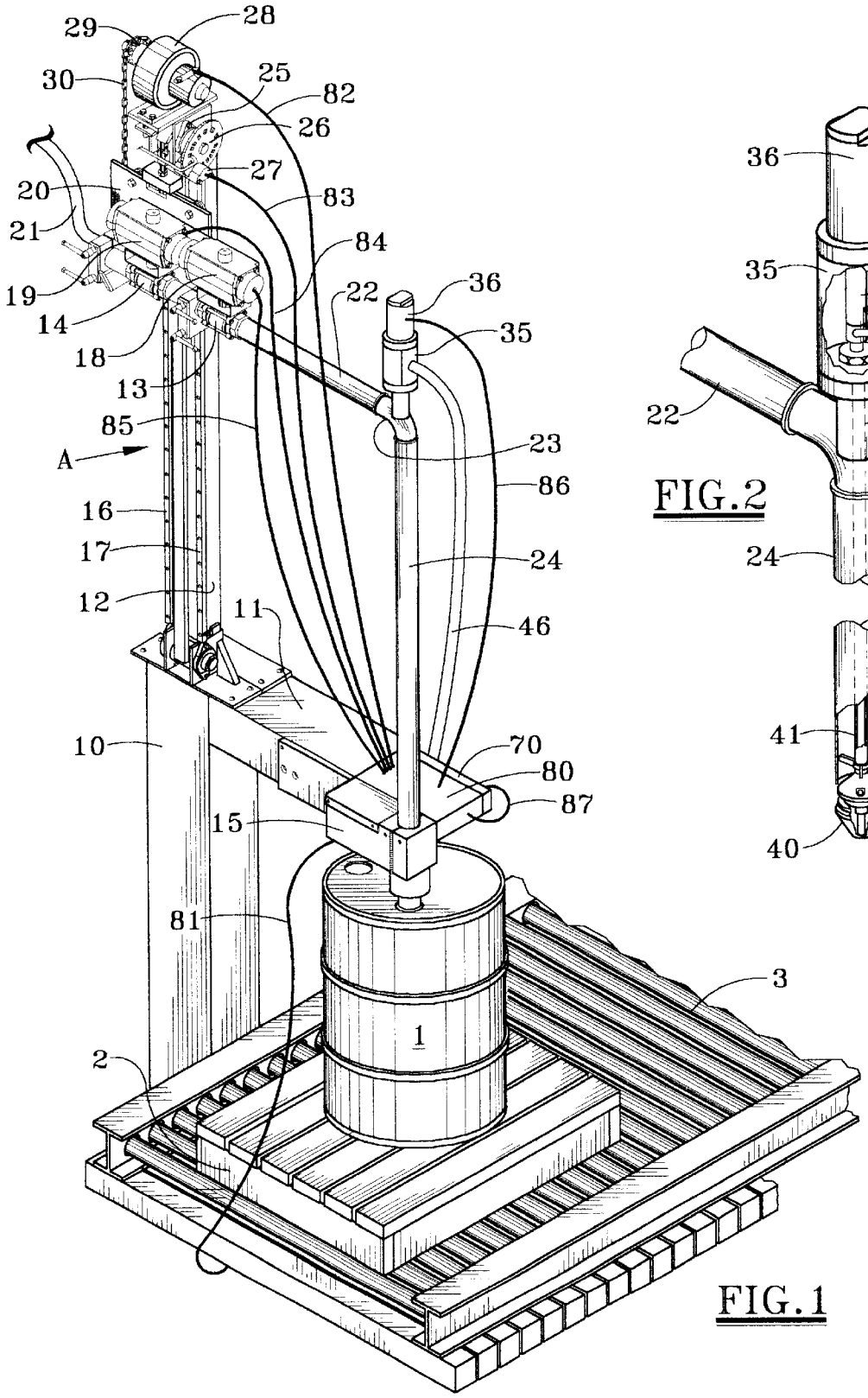
FIG. 1 is a perspective view of drum filling apparatus of the present invention, according to a preferred embodiment thereof.

Referring first to FIG. 1, there is shown apparatus A for filling drums with liquid according to a preferred embodiment of the invention. In FIG. 1, a single drum 1 is shown resting on a pallet 2. The pallet 2 is represented as being supported on a conveyor 3. The conveyor 3 is, of course, utilized to move drums, such as drum 1, from place to place. Although a single drum 1 is illustrated, it is to be understood that one, two, three, four or even more drums may be placed on a pallet for filling with the apparatus. If the drum filler of the present invention is to be utilized for filling more than one drum, it may be easily designed to accommodate such. An example of such a design is shown in U.S. Pat. No. 6,053,219 in which four drums are shown being filled. Such details are not necessary for understanding the present invention. The drum 1 would have been placed on the pallet 2 and moved on the conveyor 3 to a position and predetermined relationship with the drum filling apparatus A. After the drum 1 is filled, the pallet 2 and the filled drum 1 would be moved for capping or sealing and to loading or storage.

The filling apparatus A comprises a vertical base or support 10, a horizontal arm assembly 11, a vertical mast 12, a pair of control valves 13, 14, and a vapor or fume assembly 15. In the exemplary embodiment, the mast 12 is provided with a pair of inwardly facing rails 16, 17. A carriage assembly 20 is mounted on the mast 12 for vertical upward and downward movement thereon. The carriage assembly 20 is guided between the rails 16, 17 by wheels or rollers (not shown) which are attached to opposite sides of the carriage assembly 20 for rolling movement between the rails 16 and 17.

The control valves 13, 14 and the actuators 18, 19 therefor are mounted on the carriage 20 for movement therewith. Connected to the control valve 14 is a conduit 21 through which liquid from a supply source (not shown) is provided for filling of the drum 1. Extending from the control valve 13 is a tubular member 22, an elbow 23 and an elongated vertically disposed tubular filling lance 24 through which liquids flow for filling of the drum 1. The filling lance 24 and associated components will be described in greater detail hereafter. For present purposes, it is sufficient to understand that the filling lance 24 is operatively connected through the tubular member 22, valves 13, 14 and the conduit 21 to a source of liquid and that lance 24 may be raised or lowered, with the carriage assembly 20, by a power device to be described hereafter.

Mounted at the upper end of the mast 12 are bearing assemblies 25 which support a rotating shaft on one end of which is a rotating disk 26 and at the opposite end of which is a sprocket (not shown). The disk 26 may serve at least two functions. It may form the disk portion of a disk brake which cooperates with a disk brake actuator 27, in selective engagement or disengagement, stopping or allowing rotation of the shaft to which the disk 26 is attached. It will also be noted that the disk 26 is provided around the periphery thereof with apertures or other indicia which will indicate certain movements of the apparatus and, in particular, movement of the carriage assembly 20. Mounted at the uppermost end of the mast 12 is a motor 28, such as a gear motor, on one end of the shaft of which is a driving sprocket 29. The driving sprocket 29 is connected by a sprocket type chain 30 to other sprockets and elements (not shown) for movement of the carriage assembly 20, between rails 16 and 17, either up or down on the mast 12. The details of these elements are not required to understand the present invention. However, if a more detailed description of such is desired it may be seen in U.S. Pat. No. 6,053,219. In any event, it is to be understood that the motor 28 can rotate in either direction. Rotation of the motor shaft and sprocket 29 attached thereto will cause the chain 30 and other elements to raise or lower the carriage 20 depending upon the direction of rotation of the motor 28.

Figure 2:
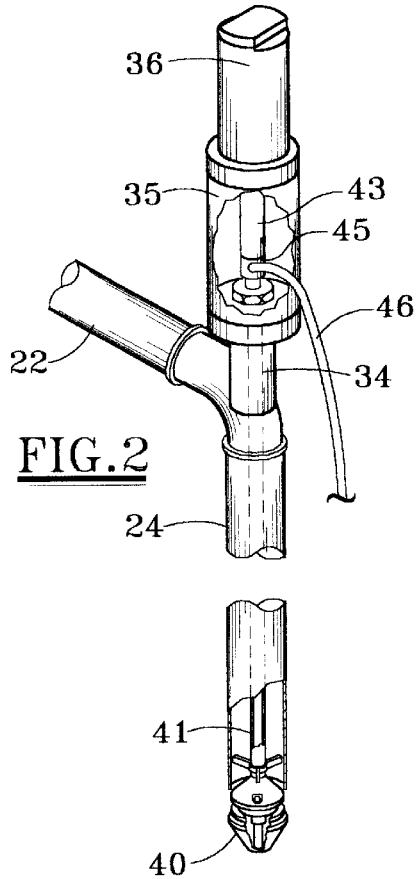
FIG. 2 is a perspective view of the lance portion of the drum filling apparatus of FIG. 1 for a clearer understanding thereof.

As previously stated, control valves 13, 14 and corresponding valve actuators 18, 19 are attached to and carried by the carriage assembly 20. The control valve 14 is in fluid communication, through the supply hose 21, with a source of liquid. The actuator 19 is capable of moving the control valve 14 between a fully opened position and a partially opened (or partially closed) position. The second control valve 13 is disposed between the control valve 14 and the tubular arm 22, connecting elbow 23 and vertical filling lance 24. It will be noted that the elbow 23 is provided with an upwardly extending tubular branch 34 (See FIG. 2) which is vertically aligned with the lance 24. Mounted above the branch 34 is a connector element 35 on which is surmounted an actuator 36.

At the lower end of the lance 24 is a foot valve 40 connected to a rod 41 which extends upwardly through the lance 24, the branch 34 and a seal assembly 42 (see also FIG.

3) provided by the connector element 35 for connection to a rod 43 from the actuator 36. Rod 41 is tubular and at the upper end thereof is connected to a fitting 45 having a port to which is connected tubular member 46, the purpose of which will be more fully understood hereafter. Thus, the passage 44 through the rod 41 is in fluid communication with the tubular member 46 and, as will be seen hereafter, a central passage or port through the foot valve 40.

Figure 4:
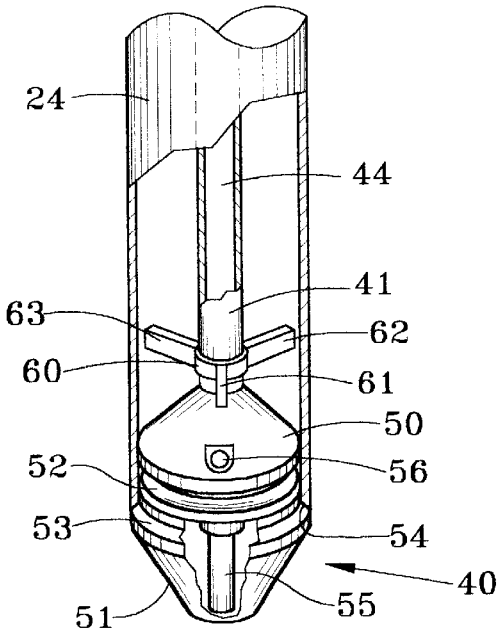
FIG. 4 is a perspective view of the lower end of the lance of the drum filling apparatus of the present invention, portions of which have been cut away, according to a preferred embodiment of the present invention.

It is to be understood that the foot valve 40, attached to rod is 41, may be reciprocated therewith by the actuator 36 between a closed position, blocking flow of fluids through the lance 24 as illustrated in FIG. 4, and an open position which allows fluid to flow through the lance 24. The foot valve 40 in the exemplary embodiment, as best seen in FIG. 4, comprises an upwardly and inwardly tapered portion 50 and a downwardly and inwardly tapered portion 51 between which is a cylindrical section provided with a groove in which may be disposed a resilient annular seal 52. The outside diameter of the cylindrical section in which the seal 52 is provided is slightly less than the internal diameter of the lance 24. Connecting the cylindrical section to the lower tapered portion 51 is a slightly outwardly flared sealing surface 53. When the foot valve 40 is closed, the upwardly tapered portion 50 and the cylindrical portion in which the seal member 52 is carried are totally encompassed by the lower end of the lance 24 and the tapered sealing surface 53 engages a corresponding tapered sealing surface at the lower end of the lance 24. The foot valve 40 has a central passage therethrough which is in communication with the passage 44 through the tubular rod 41. There is also a threaded radial hole through the tapered section 50 through which a set screw 56 may be inserted for engagement with rod 41 to hold the foot valve 40 in place.

Of course, movement of the foot valve 40 between the closed and opened positions is effected by the actuator 36 in reciprocation of the rod 41. To guide the lower end of the rod 41 and keep the foot valve 40 properly centered as they are reciprocated, a central collar, with radial support arms 61, 62, 63 may be affixed near the lower end of the lance 24.

Figure 3:
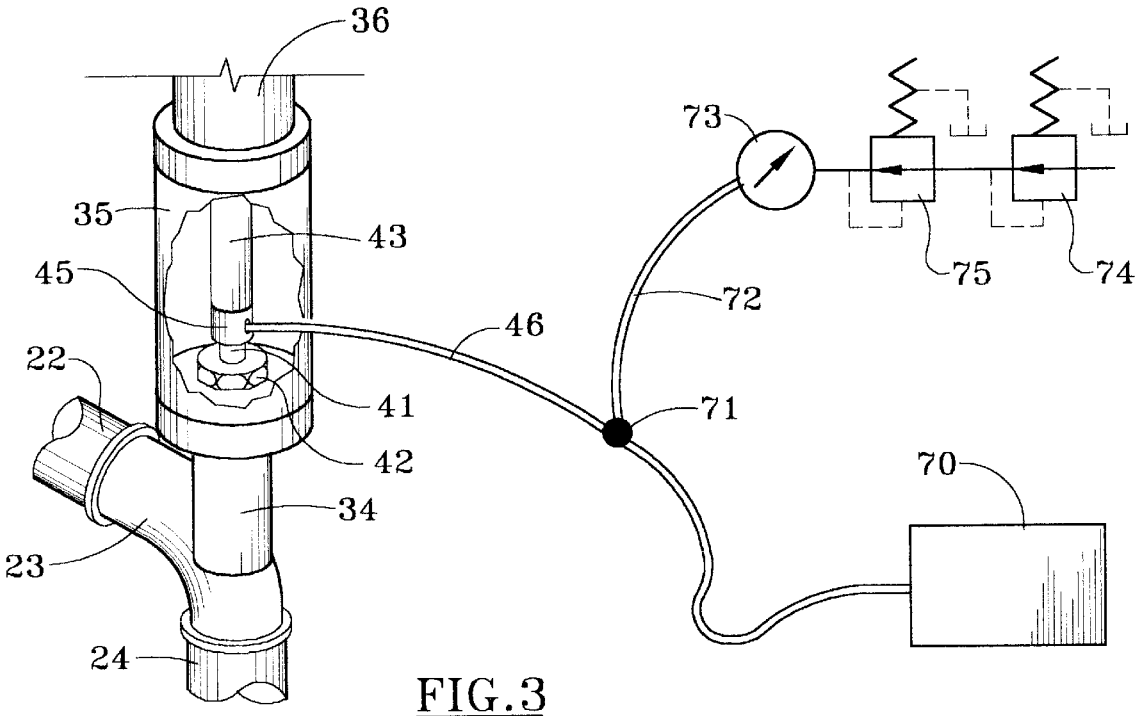
FIG. 3 is a schematic representation of the upper end portion of the lance of the drum filling apparatus of the present invention and its connection to means for sensing pressure within the lance rod, according to a preferred embodiment of the invention.
Figure 5:
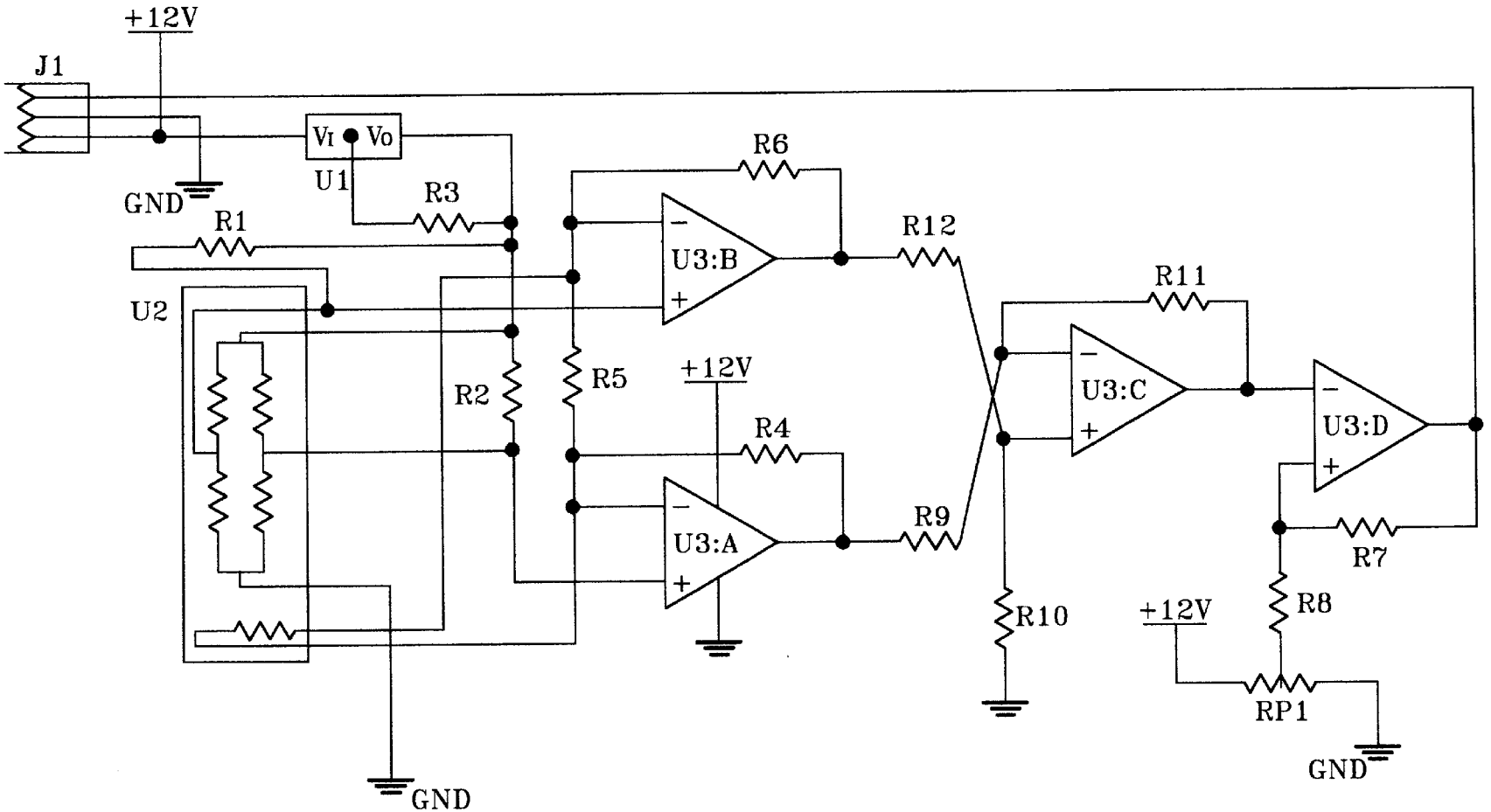
FIG. 5 is a schematic of pressure sensing and associated electrical circuitry which may be utilized in the filling apparatus of the present invention, according to a preferred embodiment thereof.

An important aspect of the present invention is the connection of the tubular member 46, as best seen in FIG. 3, to a pressure transducer and associated circuitry 70. The pressure transducer, in the preferred embodiment, is a piezoresistive silicon pressure sensor. Pressure communicated to the pressure transducer 70 through the tubular member 46 and the passage 44 of tubular rod 41 creates an electrical signal which is proportional to the pressure applied thereto. An electric circuit suitable for use therewith is shown in FIG. 5 and will be more fully described hereafter.

It will also be noted in FIG. 3 that a connector 71 provides connection for a tubular member 72 through which air or other gas may be introduced into the tubular member 46 and the passage 44 of the rod 41. In the exemplary embodiment, air from a relatively high pressure source, e.g. 85 to 115 psi, may be first passed through a pressure reducer 74 for reduction to something on the order of 20 psi and then through a second pressure reducer 75 for reduction to a very low pressure of 1 to 2 psi. A gauge 73 may be provided to monitor the pressure.

In many cases, it will not be necessary to provide low pressure air to the tubular member 46 and the passage 44 of the rod 41. When utilized, its primary purpose is to maintain a positive pressure in the tubular rod 41 and to clear the passage 44 thereof, particularly for very viscous fluids. In some cases, particularly when the container is being filled with volatile liquids, the air may be replaced by an inert gas, such as nitrogen, to maintain a non-flammable blanket above the liquids going into the drum. The volume of gas required is very small, e.g. approximately four cubic inches per minute.

Referring again to FIG. 1 there is shown a control assembly 80 which may include a programmable microprocessor and various control buttons for initiating or terminating certain events of operation. The control assembly 80 may be placed at any location and in some cases, such as shown in U.S. Pat. No. 6,053,219, may actually be at the end of an extension arm extending from the support arm 11 for operation by an operator on the opposite side of the conveyor 3. A number of control lines may extend from the control assembly 80 for sending or receiving signals. For example, line 81 may provide connection to a load cell (not shown) underneath the drum 1, pallet 2 and conveyor 3 for indicating the weight of liquids in the drum 1. Line 82 may be to the motor 28 for initiating rotation to raise or lower the carriage assembly 20. Line 83 may be connected to the disk and disk brake assemblies 26, 27 to indicate vertical positions of the carriage assembly 20 and to actuate the disk brake when necessary. Lines 84 and 85 are connected to the valve actuators 19 and 18 for operation of the valves 14 and 13. Line 86 may be connected to the actuator 36 for reciprocation of the rod 41 and the foot valve 40 attached thereto. Line 87 may be connected to the pressure transducer 70 or its electrical circuit. A number of other control lines to various components may be provided.

The pressure transducer, generally designated by the reference number "70" in FIGS. 1 and 3, is actually a combination of a piezoresistive silicon pressure sensor with associated electrical circuitry shown in FIG. 5. J1 is a connector for power in (12 volts) and a signal out U1 is a current source for circuit excitation to the pressure sensor circuit U2. The resistor R3 sets the amount of current to allow for fluctuation in input voltage.

The pressure sensor integrated circuit U2 obtains an electrical signal from the piezoresistive silicon pressure sensor which is proportional to the pressure applied thereto through tubing 46 (See FIGS. 1 and 3). The resistors R1 and R2 may be used to correct for input offset.

The amplifiers U3:A, U3:B and U3:C together with resistors R4, R5, R6, R9, R10, R11 and R12 form an instrument amplifier to convert the signal from the amplifier U2 to a useable voltage range and to allow for gain adjustments to compensate for pressure created by different products. The amplifier U3:D together with resistors R7 and R8 form a variable comparator to set a depth adjusted signal output. This provides an on/off output to raise and stop raising of the drum lance 24.

Operation of the apparatus A of the present invention and a method of filling a container or drum 1 will now be described with reference to all the drawings. Initially, filling lance 24 is positioned above an opening in the drum 1. The lance 24 would be up; the foot valve 40 would be closed and at least one of the control valves 14, 13 would be in a closed position.

Next the tubular lance 24 is lowered into the container or drum 1 just above the bottom of the drum. Lowering of the filling lance 24 is accomplished or effected through operation of the motor 28 which causes the carriage 20, valves 14, 13 and the lance 24 to move in a downward direction toward the predetermined position just above the bottom of the container or drum 1. The position of the lance 24 is sensed by a sensor which counts the number of apertures or other indicia in the disk 26 as it rotates.

At this point, one of the first and second control valves 14, 13 may be partially opened and the other control valve 14, 13 may be fully opened by their respective actuators 19, 18. In addition, the lance foot valve 40 will be opened by the actuator 36 and liquid introduced into the container or drum 1 at a dribble rate until the lower end of the tubular lance is submerged below the surface of the liquid in the container or drum 1. Alternatively, all three of the valves 14, 13 and 40 may be fully opened introducing liquid into the container at a fast fill rate.

As soon as the lower end of the lance has been submerged beneath the surface of the liquid, the liquid interfaces with the air or other gas within the tubular rod 41 and as the liquid in the container begins to rise the fluid causes the air or gas pressure in the tube passage 44 to increase. This pressure is transmitted through the tubular rod 41 and the conduit 46 to the pressure transducer 70. The pressure transducer and the associated electrical circuitry of FIG. 5 then produces a signal which is proportional to the pressure applied thereto. When the transducer indicates that the pressure at the lower end of the lance exceeds a first predetermined amount, e.g. two inches of water pressure, the signal is transmitted to the control assembly 80 which in turn signals the motor 28 causing the lance to rise, still keeping the lower end of the lance submerged below the surface of the liquid. As the lance is raised, the pressure within the passage 44 begins to fall. When it reaches a second and smaller predetermined amount, e.g. one inch of water pressure, a signal is transmitted to the control assembly 80 which, in turn, signals the motor 28 to stop raising the lance.

As liquid continues into the drum the pressure again begins to increase in the tubular passage 44 and is continually sensed by the pressure transducer 70 which continues to send signals to the control assembly 80 continuing to raise the lance, in incremental steps, as the container is filled and as the pressure near the foot valve 40 alternately exceeds the first predetermined amount and falls below the second smaller predetermined amount until the container is filled. When the liquid in the drum 1 reaches the filled point, as sensed either by the weight thereof or by the position of the lance as sensed by the disk 26, signals are transmitted to the lance foot valve 40 and the control valves 14 and 13 to shut off flow of fluids to the drum 1 and the lance 24 is raised to its uppermost or withdrawn position so the drum 1 can be closed and moved for further handling.

One of the unique features of the apparatus of the present invention is its ability to warn the operator when the lance is lowered into a drum which is completely or partially filled. As the lance 24 is lowered into the drum 1, the disk 26 indicates its vertical position and signals, by a predetermined number of pulses, when the lance is all the way to the bottom or the lowered position. However, if the lance encounters liquid above the bottom of the drum, pressure in passage 44 of the tubular rod 41 is transmitted to the pressure transducer 70, indicating that liquid has been encountered before the lance has reached its lowermost position. Operations can be interrupted and the problem corrected so that the drum 1 will not be overfilled or incompatible products will not be mixed together.

Thus, the apparatus of the present invention and the method of use thereof are unique in providing for the filling of a container with a lance which is raised in response to pressure transmitted through a tubular rod in the lance. It offers several advantages over the most recent prior art and especially in prior art drum fillers in which the lance is raised in response to weight. Although a single embodiment of the invention has been described herein, i.e. one for filling a single drum, more complicated versions for filling multiple drums may be easily designed utilizing these same principles. Furthermore, many alterations and variations of the invention may be made without departing from the spirit thereof. Accordingly, it is intended that the scope of the invention be limited only by the claims which follow.

What is claimed is:

1. Apparatus for filling containers with liquid including an elongated vertically disposed filling lance operatively connected to a source of liquid and to power means by which said lance may be vertically moved between raised and lowered positions, said apparatus comprising:

a foot valve disposed at the lower end of said lance for movement between a closed position, blocking flow of liquids through said lance, and an open position, allowing liquid to flow through said lance into said container, said foot valve having a central port therein;

a tubular rod attached to said foot valve and extending upwardly through said lance for operative connection to a foot valve actuator by which said tubular rod and said foot valve may be vertically moved between said closed and open positions, said tubular rod providing fluid communication between said foot valve port and a second port near the upper end of said rod; and pressure transducer means connected to said second port for detecting fluid pressure in said tubular rod and converting said pressure to a proportional signal which is transmitted to said power means for raising said lance a predetermined amount while keeping said foot valve and said lower end of said lance submerged beneath the surface of said container liquids.

2. Apparatus for filling containers with liquid, as set forth in claim 1, in which said proportional signal from said pressure transducer is transmitted to said power means through an electric circuit, which includes an electric power source and amplifier means, to effect upper movement and stopping of upper movement of said lance between predetermined upper and lower limits of pressure within said tubular rod.

3. Apparatus for filling containers with liquid, as set forth in claim 2, in which said electrical circuit includes a comparator by which said signal to said power means is turned on or off.

4. Apparatus for filling containers with liquid, as set forth in claim 1, including a supply of low pressure gas connected to said tubular rod near the upper end thereof and by which a positive pressure of at least a predetermined amount may be maintained in said tubular rod while said containers are being filled with liquid through said lance.

5. Apparatus for filling containers with liquid, as set forth in claim 4, in which said supply of low pressure gas is an inert gas.

6. Apparatus for filling containers with liquid, as set forth in claim 4, in which said supply of low pressure gas is air.

7. Apparatus for filling containers with liquid, as set forth in claim 4, in which the pressure of said low pressure gas is less than 2 psi.

8. Apparatus for filling containers with liquid, as set forth in claim 1, in which the lower end of said lance is provided, on the interior thereof, with a central guide which surrounds said tubular rod to keep said foot valve centered in its movement between said closed and open positions.

9. Apparatus for filling containers with liquid, as set forth in claim 1, in which said foot valve comprises an upwardly and inwardly tapered guide surface and a surrounding seal engageable with a corresponding surface on the lower end of said lance, when said valve is in said closed position, to prevent flow of fluids through said lance.

10. A method of filling a container with liquid with apparatus which includes a filling lance operatively connected to a source of liquid and to power means by which said lance may be moved between raised and lowered positions, said lance having a foot valve at the lower end thereof connected to a rod which extends upwardly through said lance for operative connection to an actuator for opening and closing said foot valve, communication being provided, through a port at said foot valve, with a pressure transducer; said method comprising the steps of:

lowering said lance through an opening in said container to a position just above the bottom of said container;

opening said foot valve to allow flow of liquids through said lance into said container;

sensing the pressure at said foot valve through said port therein with said pressure transducer;

providing a signal from said pressure transducer, proportional to said pressure at said foot valve; and raising said lance with said power means, when said pressure transducer signal indicates that the pressure at said foot valve exceeds a first predetermined amount, while keeping the lower end of said lance submerged below the surface of said liquid, until said pressure falls below a second and smaller predetermined amount.

11. The method of filing a container with liquid as set forth in claim 10 including the additional steps of:

continuing to sense the pressure at said foot valve with said pressure transducer;

continuing to raise said lance, in incremental steps, as said container is filled in response to sensing of pressure at said foot valve as it alternately exceeds said first predetermined amount and falls below said second and smaller predetermined amount until said container is filled.

12. The method of filling a container with liquid as set forth in claim 11 in which the weight of the liquid in said container is monitored by weight means, said weight means providing a cut off signal when said container is filled to terminate flow of liquid from said source of liquid and signal said power means to withdraw said lance from said container.

13. The method of filling a container with liquid as set forth in claim 10 in which said rod is tubular, providing therethrough said fluid communication between said foot valve port and said pressure sensor and including the additional step of:

providing a source of low pressure gas to said tubular rod to maintain positive pressure within said tubular rod at all times during filling of said containers.

14. The method of filling a container with liquid as set forth in claim 13 in which said low pressure gas is an inert gas.

15. The method of filling a container with liquid as set forth in claim 13 in which said gas is air.

16. The method of claim 13 in which said low pressure gas is at a pressure of less than 2 psi.

* * * * *